United States Patent [19]

Ream

[11] 4,218,975

[45] Aug. 26, 1980

[54] UNDERWATER ELECTRIC CURRENT AND ALTERNATING MAGNETIC FIELD DETECTOR

[75] Inventor: Donald F. Ream, Washington, D.C.

[73] Assignee: The United States of America as represented by the Secretary of the Navy, Washington, D.C.

[21] Appl. No.: 295,142

[22] Filed: Jun. 23, 1952

[51] Int. Cl.[3] ..... F42B 21/38; F42B 21/48

[52] U.S. Cl. ..... 102/18 M; 324/239; 324/204; 324/334

[58] Field of Search ..... 340/4; 175/183; 102/18, 102/19.2, 8, 70.2, 209, 212, 18 M; 324/29, 43, 34, 30, 40, 47, 239, 204, 334; 336/229

[56] References Cited

U.S. PATENT DOCUMENTS

| | | |
|---|---|---|
| 2,300,565 | 11/1942 | Golovizini . |
| 2,344,483 | 3/1944 | Borracci . |
| 2,412,742 | 12/1946 | Muffly . |
| 2,436,394 | 2/1948 | Maltby et al. . |
| 2,503,483 | 4/1950 | Hartman . |
| 2,542,057 | 2/1951 | Relis . |
| 2,749,509 | 6/1956 | Medlar . |
| 2,780,781 | 2/1957 | Medlar . |

FOREIGN PATENT DOCUMENTS

| | | |
|---|---|---|
| 155255 | 12/1920 | United Kingdom . |
| 188676 | 12/1922 | United Kingdom . |

OTHER PUBLICATIONS

Chapman and Bartels, Oxford University Press, 1940, pp. 445–448.

*Primary Examiner*—Theodore M. Blum

*Attorney, Agent, or Firm*—R. S. Sciascia; A. L. Branning

EXEMPLARY CLAIM

1. An underwater eddy current detector comprising a hollow elongated conducting member, said conducting member having a plurality of longitudinal conducting paths forming portions of the exterior surface of said conducting member, a portion of said conducting member formed of material having conductivity of lesser degree than said conducting member and arranged to direct eddy currents induced in said conducting member to said conducting paths, a plurality of toroidal detector coils wound upon annular laminated structures, each of said detector coils encircling one of said conducting paths, whereby a potential which is proportional to a detected signal is induced in said coils when said conducting member is submerged in a conducting medium and located in the path of flow of a plurality of currents flowing in said conducting medium.

8 Claims, 7 Drawing Figures

UNDERWATER ELECTRIC CURRENT AND ALTERNATING MAGNETIC FIELD DETECTOR

The invention described herein may be manufactured and used by or for the Government of the United States of America for governmental purposes without the payment of any royalties thereon or therefor.

This invention relates to electrical detectors and more particularly to a detector associated with underwater ordnance equipment. The detector depends for its operation on the variations in underwater electric currents produced by the galvanic action and travel of a conducting vessel in sea water. The potentials induced in the detector may be utilized to energize the firing circuit of underwater ordnance equipment.

Detection systems which depend for their operation on disturbances of the earth's magnetic field by passage of a vessel or magnetic material in the vicinity of detecting coils are well known. In these systems the vessel causes a distortion of the earth's field and thus a greater concentration of magnetic lines of flux occurs in the vicinity of the vessel for a short duration of time, which greater concentration produces a variation of flux linkages with the detector coil and induces a potential therein which may be used to energize a firing circuit of a mine or other underwater ordnance device.

Such variations in magnetic lines of force have also been used to actuate a magnetic needle to close an electrical circuit in a mine or similar device.

In the instant invention use is made of the fact that varying magnitude direct currents are produced by the galvanic action and motion of a vessel in sea water due to steel ships and submarines being made up, as a matter of necessity, of a variety of dissimilar metal fittings metallically connected to the outer portion of the hull, for example, a hull of steel and propellers of bronze, whereby in sea water a couple is formed and a strong underwater electric potential field will exist around the vessel with currents flowing in the water from steel to bronze. These underwater electrical currents flow from the hull near the bow of the vessel through the sea water and return to the hull through a low resistance path between the propeller shaft and the hull of the vessel. When the propeller shaft rotates, there is intermittent contact between the shaft and the mounting of the shaft in the hull and this intermittent contact interrupts the galvanically produced direct currents and introduces variations in the resistance path which "modulates" this direct current and causes variations above and below a fixed value. Such variations produce an alternating magnetic field which induces eddy currents in the sea water and metallic ordnance cases therein.

The instant invention concerns a device which detects the variations or "modulation electric currents" superimposed on the underwater electrical currents, eddy currents induced in sea water and metallic ordnance cases by the alternating magnetic field of the vessel and currents induced in sea water and metallic ordnance cases by the electric vector of the alternating electromagnetic wave produced by the "modulation currents".

These electric currents are detected by causing them to flow through a conducting medium such as an ordnance case which is encircled by a toroidal coil having a high permeability core. By this means a coil output voltage proportional to the encircled current magnitude is obtained.

The devices formerly used to perform the function of this invention include a solenoidal or loop coil mounted external to the ordnance case to detect the alternating magnetic fields, an array of underwater electrical potential electrode detectors in the sea water to detect variations in the underwater electrical currents, a straight wire antenna in the sea water to detect the alternating electromagnetic wave and a solenoidal or loop coil mounted inside a plastic ordnance case. The disadvantages of these methods include; [1] the use of two detector systems, a coil and an electrode array being required to detect both the alternating magnetic and variational underwater electrical potential effects; [2] ordnance rigging is encumbered by the electrode array; and [3] the detecting efficiency of the straight wire antenna is low.

Search oils used for detection of the alternating magnetic fields, when housed in plastic shells, separate from the mine case, have never been used successfully closer than about six inches from the mine case. This arrangement, while satisfactory for measuring alternating magnetic field data, is not satisfactory in an actual mine design wherein it is desired that the search coil should be located within the mine case of a service mine, if at all possible. Normally the operation of a detection coil in any mine is interferred with due to magnetic shielding by the mine case. This difficulty is overcome by the instant invention by utilizing underwater electric currents produced by the galvanic action of the vessel and the sea water, variations in such currents, produced as previously described, eddy currents induced in ordnance cases made of conducting material and the currents produced by the electric vector component of the alternating electromagnetic wave produced by the above variations.

Experiment has shown that aluminum ordnance cases provide an almost complete barrier to an enclosed alternating magnetic field solenoidal or loop detector coil. Non-magnetic steels are much better than aluminum from a shielding standpoint, but not as good as is a plastic ordnance case.

In order to overcome the disadvantages and difficulties previously indicated it is therefore a primary object of the present invention to provide an arrangement for placing detector coils associated with ordnance equipment inside the ordnance case to detect currents circulating in the case which heretofore have produced a shielding effect and interfered with the operation of such coils.

It is a further object of this invention to provide a system which utilizes the ordnance case to detect a plurality of signal currents.

It is a further object of this invention to provide a detector system associated with ordnance equipment wherein the detector coils are not sensitive to variations caused by acoustic-mechanical vibration in the earth's magnetic field.

It is a further object of this invention to provide a signal detector system for use with ordnance cases which permits frequency discrimination.

It is a further object of this invention to combine with an ordnance case a signal detecting system utilizing toroidally wound coils.

It is a further object of this invention to provide a signal detection system for use in connection with ordnance cases wherein the case, or a portion thereof, serves as the primary circuit for the detector coil or coils.

It is a further object of this invention to combine a signal detecting system with an ordnance case in such a manner to provide a simple, rugged structure.

It is a further object of this invention to provide a structure combining a signal detecting system with an ordnance case which permits efficient utilization of the eddy currents induced in the ordnance case.

Other objects and many of the attendant advantages of this invention will be readily appreciated as the same becomes understood by reference to the following detailed description when considered in connection with the accompanying drawings wherein.

Figure 1:
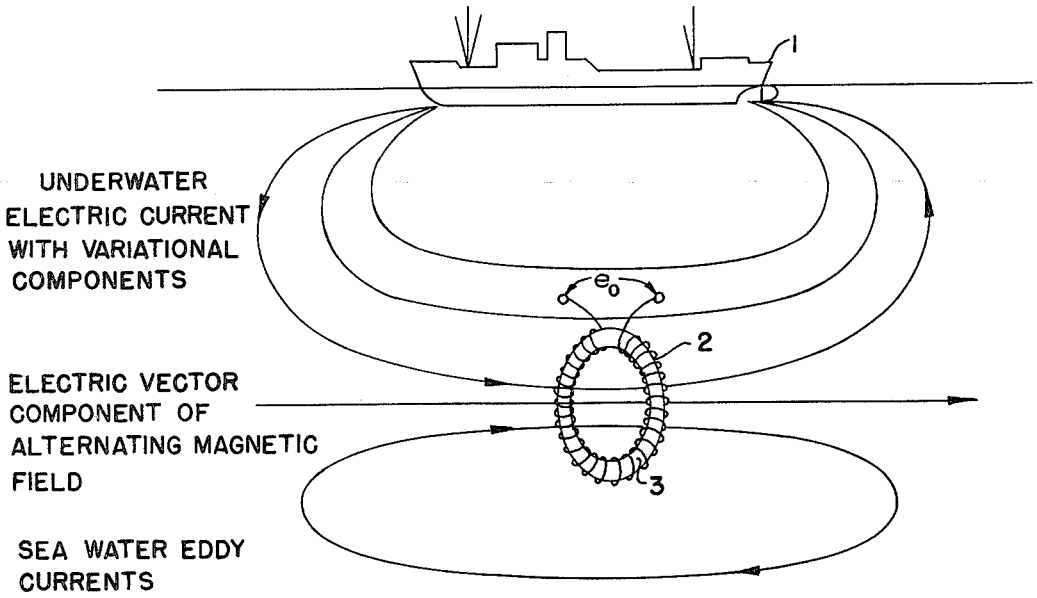
FIG. 1 represents a simple form of the invention illustrating the principles involved wherein sea water is the conducting medium linking the turns of a toroidal coil.

Referring now to FIG. 1 there is shown a toroidal coil 2 wherein sea water serves as the conducting medium linking the turns of the toroidal coil. Electric current paths produced by a vessel 1 are little disturbed by the presence of the insulated coil 2 and an output voltage, $e_o$, for application to a utilization circuit, such as a firing circuit, in a well known manner, is obtained which is proportional to the sum of the variational underwater electric currents, the alternating magnetic field produced eddy currents, and the electric currents induced in the sea water by the electric vector of the alternating electromagnetic wave. The insulated toroidal coil 2 is wound on a laminated core 3. Laminating the core produces high permeability at frequencies ranging from 10 to 10,000 cycles per second. Similar coil structures are used in the other embodiments of the invention illustrated in the other figures of the drawing.

Figure 2:
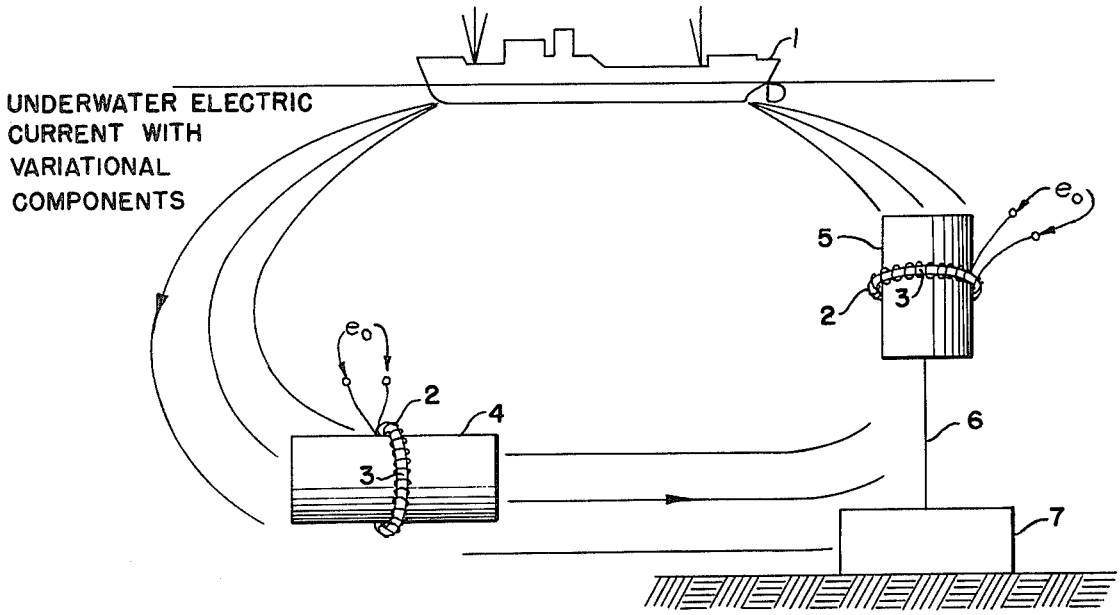
FIG. 2 represents another form of the invention wherein a metallic ordnance case is the conducting medium linking the turns of a toroidal coil.

In place of sea water as a conducting medium metallic ordnance cases 4 and 5 may be used to link the toroidal coil as illustrated in FIG. 2. Due to the high conductivity of the metallic ordnance cases 4 and 5, as compared with sea water, the currents linking the insulated coil 2 in FIG. 1 are gathered so as to increase the current density linking the effective length of the metallic current path encircled by the coil 2 and the path is increased by the steel mooring cable 6 securing the ordnance case 5 to the metallic anchor 7. The current density through the toroidal coil 2 is increased and thus the coil output voltages, $e_o$, shown in FIG. 2 are greater than the output voltages $e_o$ of FIG. 1. The output voltages of the detector coils 2 shown in FIG. 2 are proportional to the variational underwater electric currents, the alternating magnetic field produced eddy currents in sea water, and the alternating electromagnetic wave electric vector induced currents.

It is understood of course that the sub-floating device and the moored ordnance case may be used independently and need not be combined as shown.

Figure 3:
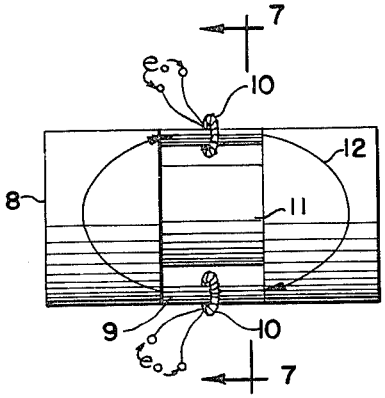
FIG. 3 is an elevational view of still another form of the invention combining a toroidal detecting coil and an ordnance case to detect eddy currents circulating in the case.
Figure 7:
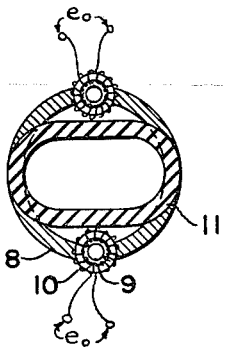
FIG. 7 is a sectional view taken on the line 7—7 of FIG. 3.

Experiment has shown that the alternating magnetic fields of ships induce circulating eddy currents in metallic ordnance cases. The embodiment shown in FIG. 3 illustrates a method of detecting these induced eddy currents wherein an ordnance case 8 is modified so that these eddy currents are confined to small conducting paths 9 which are encircled with toroidal coils 10. An insulated region 11 as shown in FIG. 7 is introduced in the ordnance case structure 8 between the paths 9 to prevent short circuiting of the coil encircled paths 9. Thus an output voltage, $e_o$, is obtained from each coil 10 which is proportional to the magnitude of the induced eddy current encircled which in turn is proportional to the incident alternating magnetic field strength.

It is to be understood that the term "insulated region" may include not only materials such as plastic, for example, but any material which has a conductivity which is relatively lower than the material of the casing. In order to increase the signal voltages obtained, the coils may be connected in aiding relation.

Figure 4:
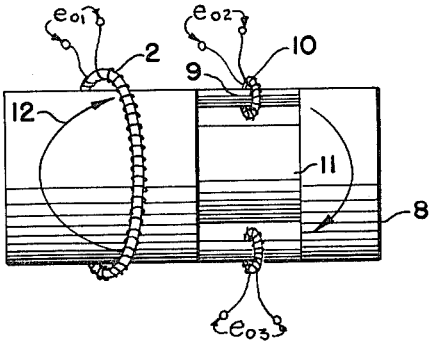
FIG. 4 is an elevational view of a structure similar to FIG. 3 with the addition of another toroidal coil to detect variations in currents produced externally of the case.

In the embodiment shown in FIG. 3 the voltage $e_o$ is proportional only to the induced eddy currents 12 which in turn are proportional to the alternating magnetic field. In order to obtain signals which are proportional not only to the eddy currents induced in the ordnance case but to the other currents as previously mentioned, an arrangement as illustrated in FIG. 4 may be used wherein not only the voltage $e_{o1}$ proportional to the alternating magnetic field produced by the varying direct currents, produced as previously indicated, is obtained but also voltages $e_{o2}$ and $e_{o3}$ which are proportional to the eddy currents induced in the ordnance case 8 are obtained. In the arrangement illustrated in FIG. 4, which is similar in structure to FIG. 3 and has an additional coil 2 encircling the case 8, the voltage $e_{o1}$ is proportional not only to the variational direct currents produced as previously indicated, but also to the electric vector component of the alternating electromagnetic wave. The detector coils 2 and 10 may be connected in a manner such that the voltages produced in each of the windings 2 and 10 are aiding and a greater total voltage for firing or controlling the ordnance device is obtained. The toroidal coils used in this embodiment of the invention as well as in the embodiments illustrated in FIGS. 1–3 may be designed to have an increased sensitivity to a particular frequency or band of frequencies.

In the embodiment of the invention shown in FIG. 2 involving a moored ordnance case an alternative arrangement of the detector coil 2 involves mounting the detector coil on the metallic anchor 7 so that it may be linked with the steel mooring cable 6. Such an arrangement reduces the noise signal due to acoustic-mechanical vibrations of the moored ordnance case 5.

Figure 5:
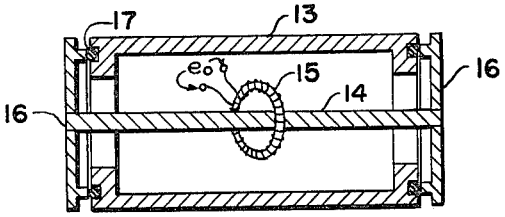
FIG. 5 is a sectional view of a further embodiment of the invention wherein a toroidal coil is combined with an ordnance case for detecting eddy currents flowing in a case having separable end caps.
Figure 6:
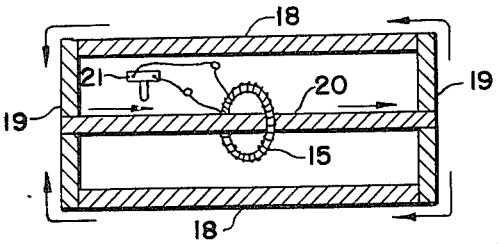
FIG. 6 is a sectional view of a further embodiment of the invention combining a toroidal coil with an ordnance case having fixed end caps.

Eddy currents induced in ordnance cases may also be detected by means of arrangements as illustrated in FIGS. 5 and 6. The embodiment of the invention illustrated in FIG. 5 comprises a conducting ordnance case 13 having a rod-like member 14 encircled by a toroidal detector coil 15. The member 14 electrically connects the two end caps 16 of the ordnance case 13. The end caps 16 are insulated from the remainder of the body portion 13 of the ordnance case by means of a suitable insulating gasket 17. This embodiment permits the detection of the varying direct currents and the induced sea water eddy currents only.

The embodiment shown in FIG. 6 has a reduced sensitivity to the varying direct currents and the induced sea water eddy currents but permits detection of the eddy currents induced in the metallic ordnance case 18, which member is encircled by a toroidal detection coil 15. The voltage output of this coil is shown schematically connected to a firing circuit including a detonator 21 to energize the same, the detonator being suitably housed within the ordnance case.

It is understood, of course, that the voltage outputs of the other toroidal detector coils may be similarly connected and that provision may be made for conventionally tuning any of the coils. In this arrangement the end caps 19 are electrically joined to the case 18 and also connected by the rod-like member 20.

The form of the invention illustrated in FIG. 5 is adapted for use with plastic or metal ordnance cases while that shown in FIG. 6 is adapted for use with the conventional all-metal ordnance cases. In the latter case, two caps as shown at 19 would be unnecessary, provided that the rod like conductor 20 could be electrically fixed to the ends 19 of the ordnance case. The induced eddy currents in the ordnance case as shown in FIG. 6 flow in the central conducting member in the manner indicated by the arrows.

There is thus provided by the instant invention a signal detecting system, the output of which may be used to energize firing circuits of ordnance devices. Difficulty due to the shielding effect of the conducting ordnance case has thus been overcome by the improved and novel arrangement of components of the instant invention wherein eddy currents induced in the sea water and conducting ordnance case, varying direct currents generated by a vessel and the electric vector component of the alternating electromagnetic wave are detected by toroidally wound coils which may be mounted internally of the ordnance case. The coils form a part of the detection system and may be designed to be frequency selective.

Obviously many modifications and variations of the present invention are possible in the light of the above teachings. It is therefore to be understood that within the scope of the appended claims, the invention may be practiced otherwise than as specifically described.

What is claimed as new and desired to be secured by Letters Patent of the United States is:

1. An underwater eddy current detector comprising a hollow elongated conducting member, said conducting member having a plurality of longitudinal conducting paths forming portions of the exterior surface of said conducting member, a portion of said conducting member formed of material having conductivity of lesser degree than said conducting member and arranged to direct eddy currents induced in said conducting member to said conducting paths, a plurality of toroidal detector coils wound upon annular laminated structures, each of said detector coils encircling one of said conducting paths, whereby a potential which is proportional to a detected signal is induced in said coils when said conducting member is submerged in a conducting medium and located in the path of flow of a plurality of currents flowing in said conducting medium.

2. An underwater electric current detecting device comprising a conducting member, said conducting member having a plurality of longitudinal conducting paths forming portions of the exterior surface of said conducting member, insulating material forming a portion of said conducting member and arranged to direct current flow in said conducting member through said conducting paths, a toroidal detector coil wound upon an annular laminated structure, said detector coil encircling said conducting member, a plurality of toroidal detector coils wound upon annular laminated structures and longitudinally spaced on said conducting member from said first named detector coil, each of said plurality of detector coils encircling one of said conducting paths, whereby currents flowing in the vicinity of said device induce currents in said conducting member and said conducting paths inducing a potential in each of said coils proportional to the currents flowing in the vicinity of said device.

3. A detecting device as recited in claim 2 wherein said first named detector coil is sensitive to varying underwater currents produced by a vessel passing in the vicinity of said device and said plurality of coils are sensitive to eddy currents circulating in a medium surrounding said device and in said conducting member.

4. In combination with an ordnance device comprising a conducting casing having a plurality of longitudinally extending members forming portions of the exterior surface of said casing, insulating means forming a portion of said casing, means encircling said longitudinally extending members for detecting current flow in said casing induced by currents flowing in the vicinity of said ordnance device and directed through said longitudinally extending members by said insulating means.

5. A combination as recited in claim 4 wherein an additional toroidal coil wound on an annular laminated structure encircles said casing in longitudinally mutually spaced relation to said plurality of coils.

6. In a means for detecting eddy currents to energize a firing circuit in an underwater ordnance device produced by the passage of a vessel in the vicinity of said ordnance device, a toroidal coil wound upon a laminated structure and arranged in encircling relation to a member forming a portion of said device, said portion being insulated to confine the flow of eddy currents induced in said device to a path including the member encircled by said coil, said coil being connected to said firing circuit, whereby the passage of a vessel in the vicinity of the device induces a potential in said coil to energize said firing circuit.

7. A means for detecting variable frequency underwater currents, comprising a plurality of toroidal coils each wound upon individual annular laminated structures, said coils being arranged in encircling relationship about portions of a conducting device, parts of said device being insulated to direct the path of flow of circulating currents of variable frequency within said conducting device to the portions encircled by said coils, said device being submerged, whereby circulating currents are detected and induce potentials in said coils which are proportional to the circulating currents.

8. A means for energizing an underwater ordnance device including a firing circuit utilizing underwater electrical currents, comprising a plurality of toroidal coils each wound upon individual laminated annular structures, said coils being arranged in encircling relationship about portions of an underwater ordnance device, said coil encircled portions of said ordnance device being insulated to direct the path of flow of circulating currents induced within said ordnance device by underwater electrical currents to the portions encircled by said coils, said device being submerged, said firing circuit being energized by potentials induced in said coils.

* * * * *